US005690364A

United States Patent [19]

Oleske et al.

[11] Patent Number: 5,690,364

[45] Date of Patent: Nov. 25, 1997

[54] CALENDAR

[76] Inventors: Joseph A. Oleske; Rosanne Oleske, both of 704 Woodchuck La., Toms River, N.J. 08755

[21] Appl. No.: 642,416

[22] Filed: May 3, 1996

[51] Int. Cl.[6] ..... B42D 15/00

[52] U.S. Cl. ..... 283/2; 283/111

[58] Field of Search ..... 283/2–4, 67, 81, 283/89, 900, 901, 111, 99, 98; D19/20–22; 434/108, 304, 427; 40/107, 119, 615, 391

[56] References Cited

U.S. PATENT DOCUMENTS

| | | | |
|---|---|---|---|
| 4,232,462 | 11/1980 | Longenecker | 40/119 |
| 4,451,067 | 5/1984 | Williams | 283/2 |
| 4,975,061 | 12/1990 | Avril . | |
| 5,123,191 | 6/1992 | Kim | 283/2 |
| 5,135,260 | 8/1992 | Irlik et al. . | |
| 5,195,262 | 3/1993 | Roane . | |
| 5,316,342 | 5/1994 | Almo . | |
| 5,339,546 | 8/1994 | Rahwan | 40/107 |

FOREIGN PATENT DOCUMENTS

| | | | |
|---|---|---|---|
| 515150 | 8/1955 | Canada | 40/107 |
| 918234 | 9/1954 | Germany | 40/119 |
| 443138 | 12/1948 | Italy | 40/107 |

OTHER PUBLICATIONS

"Miller's Office Products" p. 294, Items G and H, Dec. 1994.

*Primary Examiner*—Daniel W. Howell
*Assistant Examiner*—G. Andoll
*Attorney, Agent, or Firm*—Brumbaugh, Graves, Donohue & Raymond

[57] ABSTRACT

A calendar comprises a multiplicity of base sheets, each of which bears visual indicia of a plurality of day dates in a matrix of date sections. Each day date indicia occupies only a day date image portion of each date section, thus leaving a portion of each date section blank. The day date image portions of all date sections of all sheets correspond in size and position. The calendar further comprises an overlay sheet bearing graphic material in a matrix of image sections that correspond to and register with the date sections of the base sheets. Each graphic image appears only in an image portion of each image section. Each image section of the overlay sheet has a window that corresponds to and registers with the day date image portion of the date sections of each base sheet so that the day date indicia are fully visible through the windows of the overlay sheet. Preferably, the base sheets and the overlay sheet are joined by a binder along corresponding edges, and the base sheets are separable from the binder, such as by tearing them off.

18 Claims, 5 Drawing Sheets

CALENDAR

BACKGROUND OF THE INVENTION

Calendars of the type having monthly sheets and covering a calendar year of the type that many people hang up on walls, kitchen cabinets, file cabinets and the like frequently include graphic material (photographs, drawings, paintings, and the like) for decorative purposes. Ordinary, the graphic material appears at the top end of the calendar, and the date data appear at the bottom, which allows the current month page to be turned up for viewing and adding notes to later month pages. Each page may have graphic material, so that the decorative material is changed as the user changes the calendar from month to month. Alternatively, the calendar may have a header panel at the top, which contains the decorative graphics that appears for the whole year, and separate monthly sheets attached to the lower edge of the header panel, such as by a spiral wire connector.

Each of the above-described formats, which are merely exemplary of known hanging calendars, presents decorative material in one section and date data in another section. Almost universally, the date data appears in a matrix of boxes, one for each day of the month, arranged in seven columns—one for each day of the week—and five rows—one for each week or partial week of the month. The month is printed at the top of each date data section, and the days of the week are printed as headers for each column. Commonly, the numerical date is printed in a corner of each box, thereby leaving space in each box for the user to enter notations of appointments and reminders.

The format of previously known hanging calendars makes them of limited decorative value. While the graphics section may be somewhat aesthetically appealing, the date data section of lined-off, numbered boxes has little decorative value.

SUMMARY OF THE INVENTION

An object of the present invention is to provide a calendar having a higher level of aesthetic appeal than that of previously known calendars. A further object of the invention is to provide a calendar that has more decorative material than previously known calendars but still displays the date data. Yet another object is to retain, where desired, the capability of having notations inserted in the date boxes. It is also an optional object that the presence of the notations be apparent, though not necessarily readable, when the graphics material is presented.

The foregoing objects are attained, in accordance with the present invention, by a calendar that comprises a multiplicity of base sheets. Each base sheet bears visible indicia of a plurality of day dates in a matrix of date sections. Each day date indicia occupies only a day date image portion of each date section, thus leaving a portion of each date section blank. The day date image portions of all date sections of all base sheets correspond in size and position. The calendar further comprises an overlay sheet bearing a graphic image in each of a matrix of image sections that correspond to and register with the date sections of the base sheets. Each graphic image appears only in an image portion of each image section, thereby leaving a window portion that corresponds to and registers with the day date image portion of the date sections of each base sheet so that the day date indicia are fully visible through the overlay sheet. Preferably, the base sheets and the overlay sheet are joined by a binder along corresponding edges, and the base sheets are separable from the binder, such as by tearing them off.

Although a calendar, according to the present invention, may have base sheets for time periods other than a month, such as a separate sheet for each week, it is best suited for a year calendar having 12 monthly sheets, each of which carries day date indicia for a calendar month. Similarly, the invention is not limited to hanging calendars but may be in a booklet format for use on a desk. The arrangement of the matrix for the date data on the sheets may also vary. The standard format of seven columns and five rows is, however, highly preferred, because people are accustomed to that format and read the days of the weeks instinctively.

The invention provides graphic material as the predominant element of what an observer sees when looking at the calendar. The graphic images in the image sections of the overlay sheet, in totality, produce a decorative effect that tends to conceal, particularly from a distance, the fact that one is looking at a calendar. On the other hand, the appearance of the date data through the windows of the overlay sheet preserves the utility of the calendar by permitting an observer to see clearly the date data. As contrasted to conventional calendars, a calendar according to the present invention, by virtue of the graphics material of the overlay sheet, is mainly a work of graphic art, pleasing to observe.

Advantageously, the overlay sheet may be transparent, which is best accomplished by making it of a suitable clear plastic material, preferably a flexible plastic sheet material. In such a form it is durable and can be flexed to allow a user to make notations in the blank portions of the date sections of the base sheets. Also, the graphic images on the overlay sheet may be translucent images, similar to or actually photographic transparencies so that each blank portion of each date section of each blank sheet is partly visible though the corresponding image portion of the overlay sheet. The images may substantially fully occupy each image portion of the overlay sheet, or they may occupy only part of each image portion. The images may be of the same sizes and shapes or different sizes and shapes. For greater aesthetic interest, it is preferable that the graphic content of at least some, and even all, images on the overlay sheet be different.

A calendar, in accordance with the invention, may have, in addition to the image sections of the overlay sheet, at least one second portion containing at least one additional graphic image. For example, the calendar may have a header component, which may bear one or more graphic images and to which the base sheets and the overlay sheet are suitably attached at a common juncture. The juncture may be of hinge form, such as a spiral wire hinge or an equivalent hinge-type binder that allows the overlay sheet and each base sheet to be rotated relative to the header component to facilitate turning up the overlay sheets and one or more base sheets to reveal a selected month.

For a better understanding of the invention, reference may be made to the following description of an exemplary embodiment, taken in conjunction with the accompanying drawings.

DESCRIPTION OF THE EMBODIMENT

Figure 1:
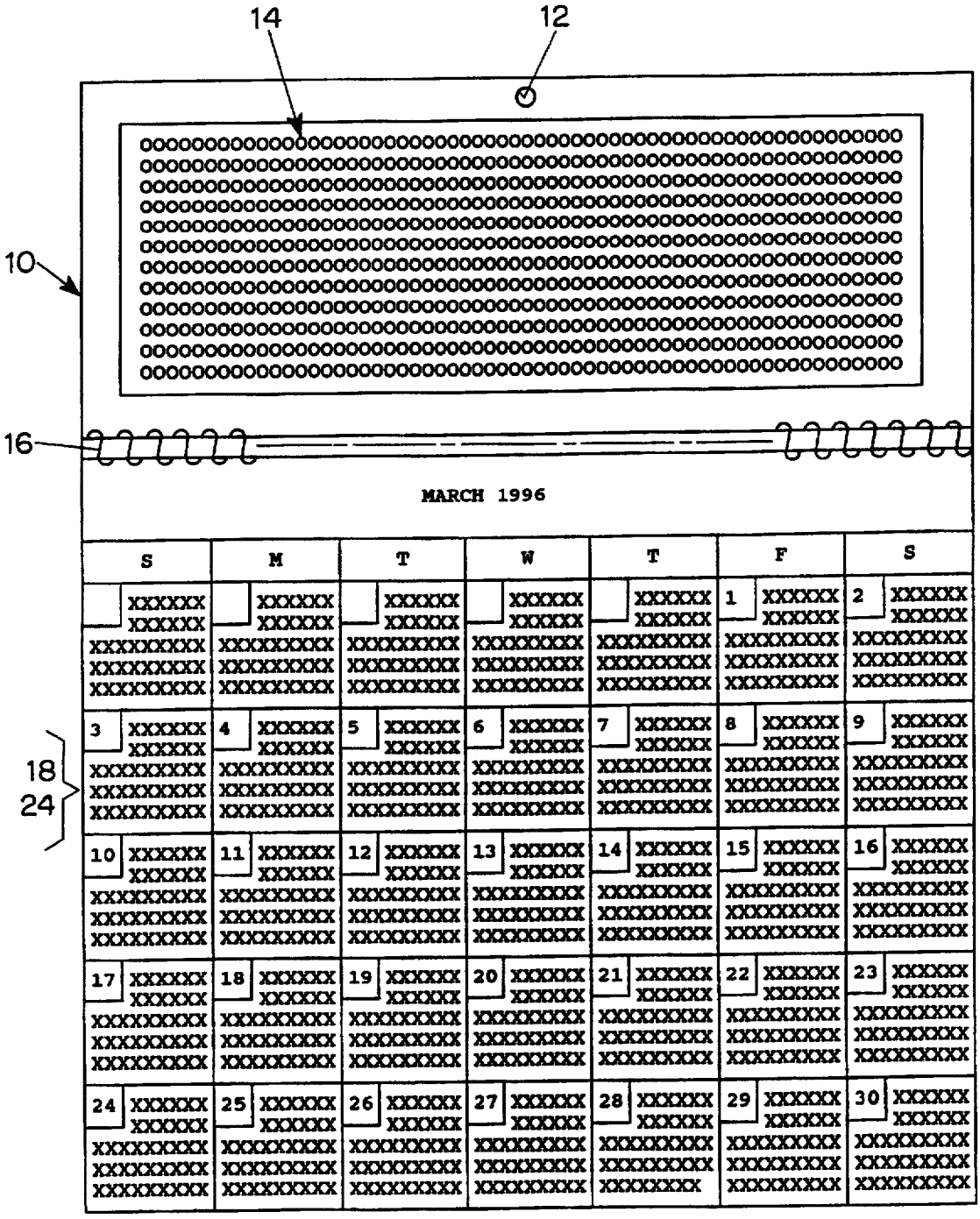
FIG. 1 is a front elevational view of a calendar embodying the present invention.

The calendar shown in the drawings is an annual calendar and is constructed such that it can be hung on a wall or other vertical surface. It has a header card 10, which may be of paperboard, plastic, wood, metal or any suitable sheet material. A hole 12 at the top center permits it to be hung on a nail or hook. The "O"s 14 on the header card 10, as shown in FIG. 1, represent diagrammatically graphic material, which may or may not be lined off or framed, as shown.

As used herein, the term "graphic material" is used broadly to refer to a visible image, which may be predominantly pictorial but which may also include, or even consist only of, words or symbols. The pictorial subject matter may be created by photography, drawing, or painting and may be reproduced on the substrate in any suitable manner, printing being the most likely form of reproduction. The content of the graphic material may, of course, be anything that the producer of the calendar chooses. Some examples, which are merely representative, are described below.

Figure 2:
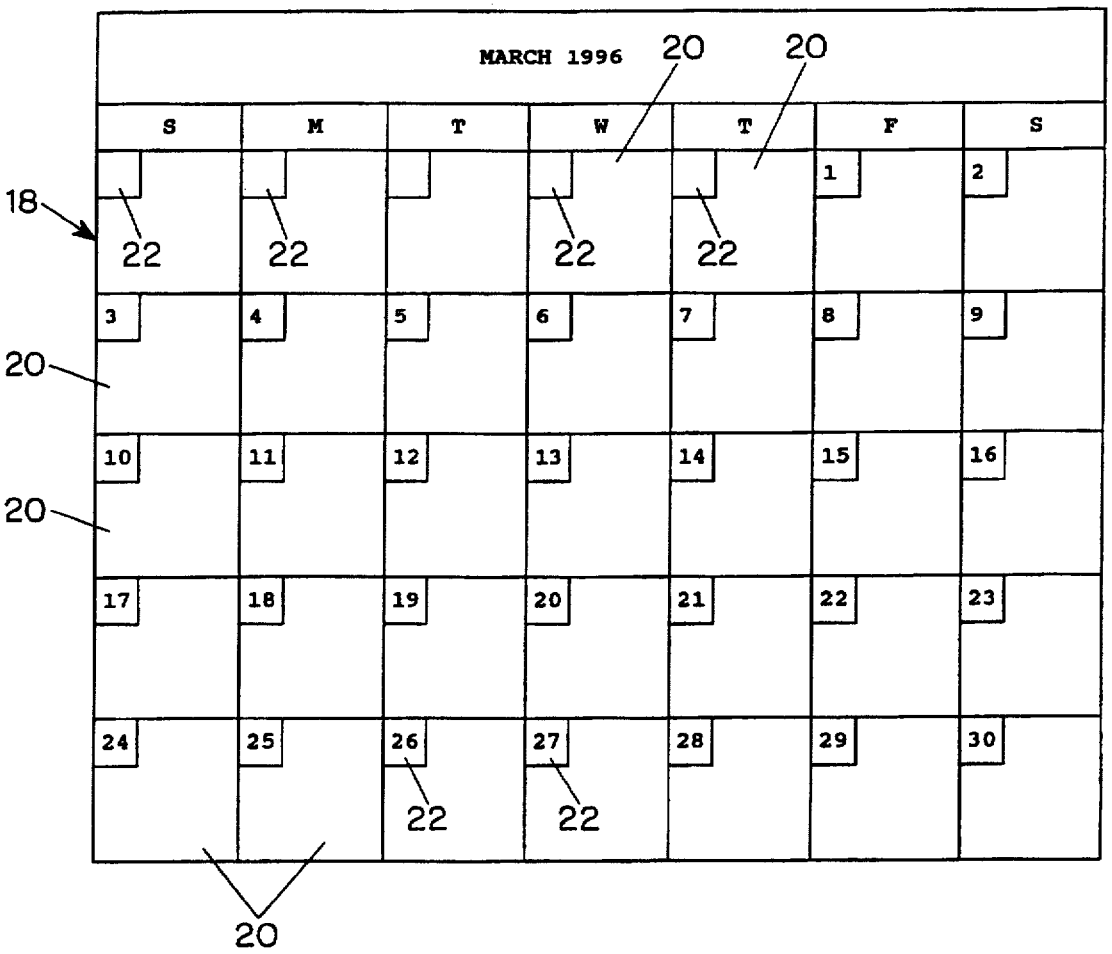
FIG. 2 is a front elevational .view of a date data base sheet of the calendar of FIG. 1;.

Attached in a suitable manner, such as by a spiral wire connector 16, to the lower edge of the header card 10 is a set of 12 base sheets 18, one for each month of the year. Each base sheet (FIG. 2), which may be of paper or light-weight paper board, contains a matrix of date sections 20, which are arranged, as is customary, in seven columns, one for each day of a week, and five rows, one for each week or part of a week of a month. The date sections 20 are, preferably though not necessarily, set off by lines. The date sections contain date data indicia, i.e., the numerical dates of the days of the month in the embodiment. The date data occupy only small day date image portions 22 of the date sections, as indicated by the boxes in the upper left hand corner or each of date section. The date sections of all base sheets 18 correspond in size and position, and the day date image portions 22 of all date sections of all sheets correspond in size and position. Each date section 20 of each base sheet has a blank portion, namely the part of each date section outside of the box in which the numerical date appears. Lining off of the day date image portions of the date sections is entirely optional and is, preferably, omitted for aesthetic reasons.

Figure 3:
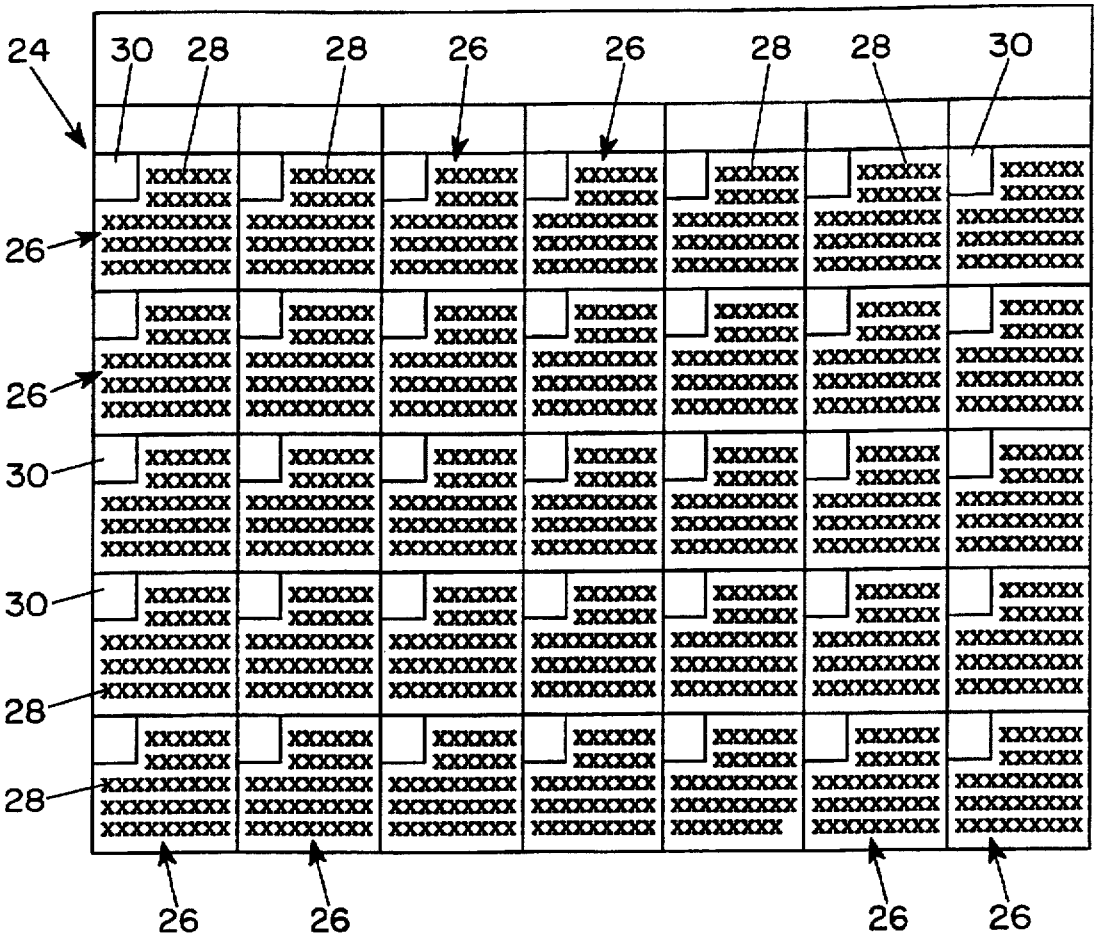
FIG. 3 is a front elevational view of the overlay sheet of the calendar of FIG. 1.
Figure 4:
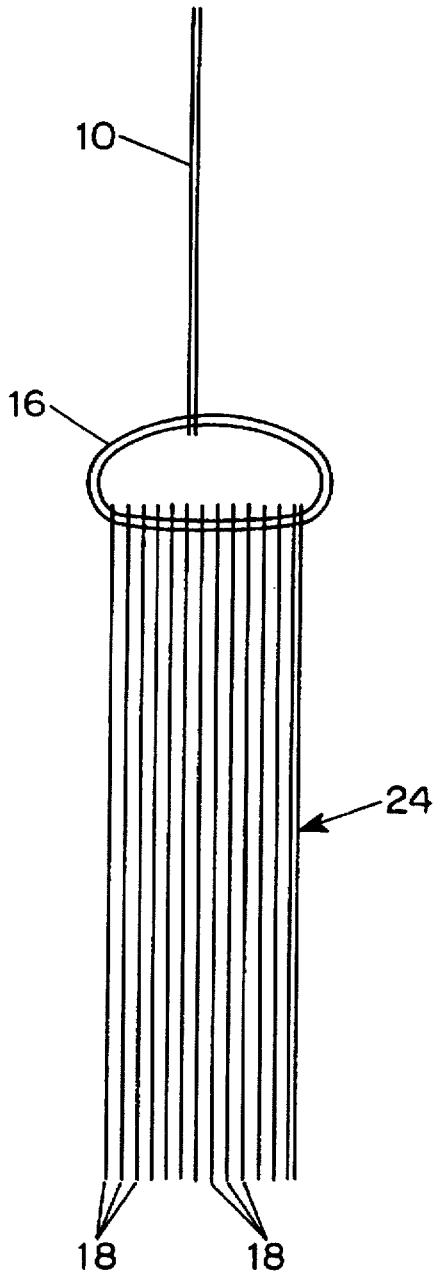
FIG. 4 is a schematic side elevational view of the calendar of FIG. 1.

An overlay sheet 24 is attached to the header card 10 by the connector 16 in front of the 12 base sheets. The overlay sheet is, preferably, made of transparent material, such as clear flexible plastic sheet material, and bears graphic material in image sections 26 (FIG. 3). The image sections 26 of the overlay sheet correspond to and register with the date sections 20 of the base sheets 18. The graphic material on the overlay sheet, which is represented diagrammatically by the "X"s in the drawings, is present only in an image portion 28 of each image section 26, i.e. within the L-shaped area bounded by the bottom and side margins and parts of the left and top margins of each image section 26 and by the right and lower edges of the small box 30 in the upper left corner of each image section 26. The small boxes 30 represent windows in the overlay sheet, which register with the day date image portions of the base sheets and through which the numerical dates are visible though the overlay sheet.

The lines setting off the image sections 26 and the image portions 28 of the image sections 26 in FIG. 3 merely indicate those sections and portions. Although the overlay sheet may have the lines shown in FIG. 3, they will usually not be present for aesthetic reasons and because any lines on the base sheet will be visible through the overlay sheet when the overlay sheet is transparent. Usually, only graphic material will appear on the overlay sheet.

The graphic material in each image portion 28 may occupy all or only a part of each image portion. Like the graphic material of the header card 10, the graphic material in each image portion of the overlay sheet may include or consist of pictorial images, words or symbols. In fulfillment of the objective of the invention of enhancing the aesthetic character of a calendar, the graphic material of the overlay sheet will usually be predominantly pictorial in nature, such as photographs, drawings, or paintings.

Generally, the graphic material of the header cards and of the overlay sheet will be related in subject matter. For example, the graphic material in the header card may be a group photograph or drawing of a sports team or a collage of photographs or drawings of "hall-of-fame" sports figures. In those cases, the graphic material on the overlay sheet may be individual photographs, drawings, or paintings of the faces of the players shown in the header. The header may also include the name of the team or the hall of fame organization. Other examples of graphic material for the calendar include:

| Header Images | Overlay images |
|---|---|
| auto race track | race cars |
| horse race track | race horses |
| a company logo | company's products |
| scene with cars | individual car models of mfg. |
| Stanley Cup teams | team players |
| Super Bowl teams | team players |
| NBA championship | team players |
| recreation setting | recreation paraphernalia |
| hunting scene | hunting prey and/or equipment |
| fishing scene | fish or lures or equipment |

The above examples are, of course, only a handful of the many possible themes for calendars. Commonly, the themes will involve recreation and sports and appeal to enthusiasts. Commercial promotional themes are also effectively presented by the calendar.

The overlay sheet 24 of the calendar can be reproduced by printing or by a photographic process. The images can be translucent, which will permit any notes made on the date blanks of the base sheets to be at least partly visible and prompt the observer to look at them by lifting up the overlay sheet.

Figure 5:
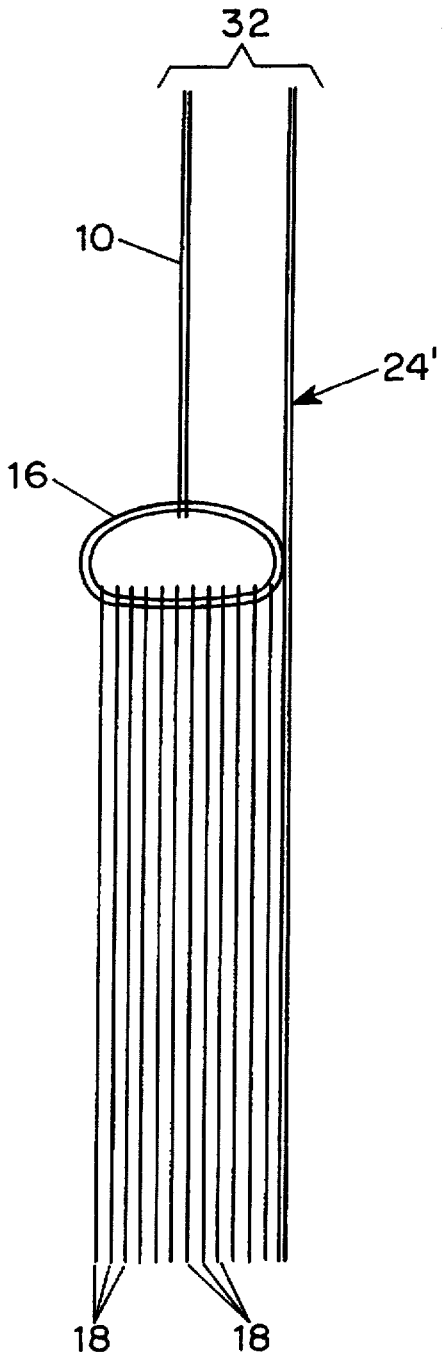
FIG. 5 is a schematic side elevational view of a modified embodiment.
Figure 6:
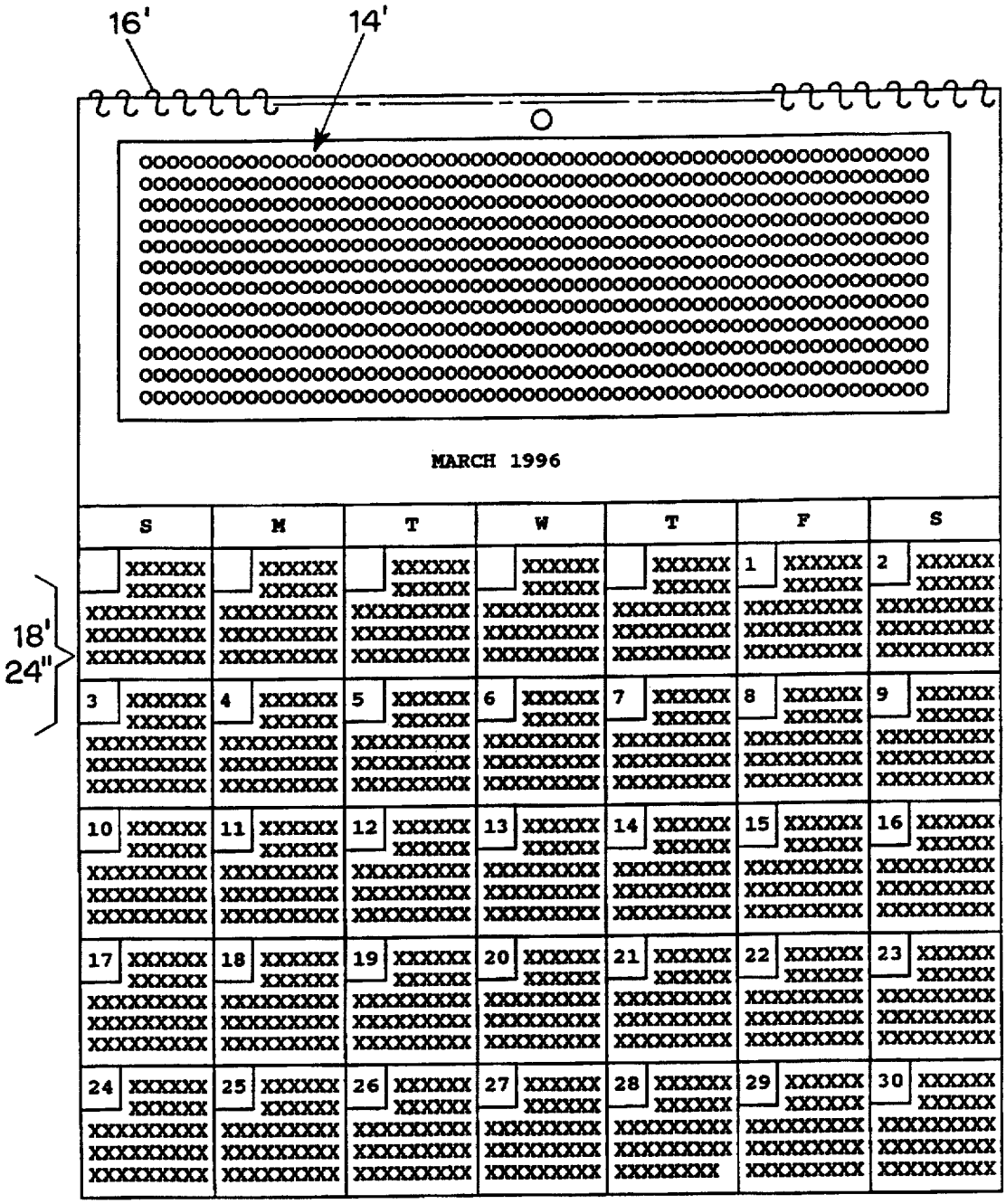
FIG. 6 is a front elevational view of another calendar embodying the present invention.

FIG. 5 shows a calendar in which the overlay sheet 24' extends the full height of the calendar and is attached by a suitable connector 32 (shown schematically) to the header card 10. The upper part of the overlay sheet will bear graphic material. It is apparent that the calendar may also have a full height overlay sheet 24" and full height base sheets 18' bound at the top, as shown in FIG. 6. The overlay sheet 24" of FIG. 6 has a portion 14' bearing graphics material (indicated by "O"s). The base sheets 18' and overlay sheet 24" are bound at the upper edges by a connector 16'.

The calendar can be constructed so that the header card and overlay sheet or the overlay sheet alone can be reused from year to year. In that case, the connector that joins them may be of a type that allows new base sheets for each year to be attached to the header or to the overlay sheet.

Although it is preferable for the overlay sheet to be transparent, that is not required. The overlay sheet may be opaque and have windows cut out to permit the date data to be viewed. It is contemplated, also, that the header card can be omitted and that the calendar can be for desk use.

We claim:

1. A calendar comprising a multiplicity of base sheets, each base sheet bearing visible indicia of a plurality of day dates in a matrix of date sections, each day date indicia occupying only a day date image portion of each date section and the day date image portions of all date sections of all base sheets corresponding in size and position, and each date section of each base sheet having a blank portion, and an overlay sheet bearing graphic material in each of a matrix of image sections that correspond to and register with the date sections of the base sheets, the graphic material appearing in an image portion of each image section, and each image section of the overlay sheet having a window that corresponds to and registers with the day date image portion of the date section of the base sheet underlying the overlay sheet so that the day date indicia are visible through the overlay sheet through the windows.

2. A calendar according to claim 1 wherein each base sheet bears day date indicia for a calendar month.

3. A calendar according to claim 2 wherein each base sheet contains a matrix of date sections in seven columns, each corresponding to a name day of each week, and in five rows, each corresponding to a week or partial week of the month for that base sheet.

4. A calendar according to claim 1 wherein the overlay sheet is transparent.

5. A calendar according to claim 4 wherein the graphic material on the overlay sheet is translucent so that the blank portions of each date section of each blank sheet are partly visible though the corresponding image portions of the overlay sheet.

6. A calendar according to claim 1 and further comprising a header card joined to corresponding edges of the base sheets.

7. A calendar according to claim 1 wherein the matrix of image sections on the overlay sheet occupies one portion of the overlay sheet and the overlay sheet has at least one second portion containing graphic material.

8. A calendar according to claim 1 wherein the base sheets and the overlay sheet are joined by a binder along corresponding edges.

9. A calendar according to claim 8 and further comprising a header card joined to corresponding edges of the base sheets and overlay sheet by the binder.

10. A calendar according to claim 8 wherein the base sheets are separable from the binder.

11. A calendar comprising a multiplicity of base sheets, each base sheet bearing visible indicia of the day dates for a calendar month in a matrix of date sections, the matrix of date sections being arranged in seven columns, each corresponding to a name day of each week, and in five rows, each corresponding to a week or partial week of the month for that base sheet, each day date indicia occupying only a day date image portion of each date section and the day date image portions of all date sections of all sheets corresponding in size and position, and each date section of each base sheet having a blank portion, and an overlay sheet bearing graphic material in each of a matrix of image sections corresponding to and in register with the date sections of the base sheets, the graphic material appearing only in image portions of each image section, and each image section of the overlay sheet having a window that corresponds to and registers with a day date image portion of the date sections of each base sheet so that the day date indicia are visible through the windows of the overlay sheet.

12. A calendar according to claim 11 wherein the overlay sheet is transparent.

13. A calendar according to claim 12 wherein the graphic material on the overlay sheet is translucent so that each blank portion of each date section of each blank sheet is partly visible though the corresponding image portion of the overlay sheet.

14. A calendar according to claim 11 wherein the matrix of image sections on the overlay sheet occupies one portion of the overlay sheet and the overlay sheet has at least one second portion containing at least one additional graphic image.

15. A calendar according to claim 11 wherein the base sheets and the overlay sheet are joined by a binder along corresponding edges.

16. A calendar according to claim 15 and further comprising a header card joined to corresponding edges of the base sheets and overlay sheet by the binder.

17. A calendar according to claim 16 wherein the base sheets are separable from the binder.

18. A calendar comprising a multiplicity of base sheets, each base sheet bearing visual indicia of a plurality of day dates in a matrix of date sections, each day date indicia occupying only a day date image portion of each date section and the day date image portions of all date sections of all sheets corresponding in size and position, and each date section of each base sheet having a blank portion, and an overlay sheet of transparent material bearing graphic material in a matrix of image sections that correspond to and register with the date sections of the base sheets, the graphic material appearing only in image portions of each image section and the graphic material on the overlay sheet being translucent so that each blank portion of each date section of each blank sheet is partly visible though the corresponding image portion of the overlay sheet, and each image section of the overlay sheet having a window corresponding to and in register with a day date image portion of the date sections of each base sheet so that the day date indicia are visible through the windows of the overlay sheet.

* * * * *